US008584884B2

(12) United States Patent
Learn et al.

(10) Patent No.: US 8,584,884 B2
(45) Date of Patent: Nov. 19, 2013

(54) CONTAINER HAVING A FOLDABLE SUPPORT AND LID

(75) Inventors: Angela E. Learn, Gilbertsville, PA (US); Kyle Karvola, Glendale Heights, IL (US)

(73) Assignee: Pactiv Packaging Inc., Lake Forest, IL (US)

( * ) Notice: Subject to any disclaimer, the term of this patent is extended or adjusted under 35 U.S.C. 154(b) by 130 days.

(21) Appl. No.: 13/240,537

(22) Filed: Sep. 22, 2011

(65) Prior Publication Data

US 2013/0075392 A1 Mar. 28, 2013

(51) Int. Cl.

| | |
|---|---|
| ***B65D 3/20*** | (2006.01) |
| ***B65D 3/24*** | (2006.01) |
| *B65D 3/06* | (2006.01) |

(52) U.S. Cl.

USPC ..... 220/23.8; 220/23.86; 220/505; 220/522; 229/404

(58) Field of Classification Search

USPC ..... 220/6, 23.8, 23.2, 23.86, 505, 522; 229/404

See application file for complete search history.

(56) References Cited

U.S. PATENT DOCUMENTS

| | | | | |
|---|---|---|---|---|
| 677,017 | A | | 6/1901 | Carrington |
| 2,112,959 | A | | 4/1938 | Harvey |
| 2,385,898 | A | | 10/1945 | Waters |
| 2,761,448 | A | | 9/1956 | Monroe |
| 3,580,473 | A | | 5/1971 | Gill |
| 3,630,430 | A | | 12/1971 | Struble |
| 3,809,310 | A | * | 5/1974 | VanderLugt, Jr. ..... 229/110 |
| 4,020,988 | A | | 5/1977 | Kipp |
| 4,185,764 | A | | 1/1980 | Cote |
| 4,252,264 | A | | 2/1981 | Herbst et al. |
| 4,267,955 | A | | 5/1981 | Struble |
| 4,502,623 | A | | 3/1985 | Moore, Jr. et al. |
| 4,552,293 | A | | 11/1985 | Blagg et al. |
| 4,714,190 | A | * | 12/1987 | Morrocco ..... 229/404 |
| 4,718,595 | A | | 1/1988 | Jones |
| D306,975 | S | * | 4/1990 | Brondyke et al. ..... D9/431 |
| 4,915,235 | A | * | 4/1990 | Roosa ..... 229/243 |
| 5,301,870 | A | | 4/1994 | Smith et al. |
| 5,417,364 | A | | 5/1995 | Shaw |
| 5,626,283 | A | * | 5/1997 | Mellon ..... 229/120.13 |
| 5,720,429 | A | | 2/1998 | Cordle |
| 5,842,631 | A | | 12/1998 | Berger |

(Continued)

OTHER PUBLICATIONS

International Search Report and Written Opinion for PCT/US2011/052732, dated May 24, 2012 (corresponds to U.S. Appl. No. 13/240,537).

*Primary Examiner* — Mickey Yu
*Assistant Examiner* — Niki Eloshway
(74) *Attorney, Agent, or Firm* — Baker Botts LLP

(57) ABSTRACT

Food container is provided having a first body portion and a second body portion. The first body portion and the second body portion are joined together to define an interior of the container and a mouth to the interior. The first body portion has a first flap moveable between an open position and a closed position, and the first flap includes a foldable support formed therein to hold a receptacle when in the open position. The second body portion has a second flap moveable between an open position and a closed position, and the second flap includes a tab to engage the first flap in the closed position to form a lid across the mouth of the interior. A blank for forming the food container from a sheet of blank material is also provided.

45 Claims, 16 Drawing Sheets

(56) References Cited

U.S. PATENT DOCUMENTS

| | | | | |
|---|---|---|---|---|
| 5,875,957 | A | 3/1999 | Yocum | |
| 6,053,403 | A | 4/2000 | Cai | |
| 6,102,208 | A * | 8/2000 | Huang | 206/541 |
| 6,216,946 | B1 | 4/2001 | Cai | |
| 6,360,944 | B1 * | 3/2002 | Gorman | 229/400 |
| 6,561,414 | B1 | 5/2003 | Cai | |
| 6,592,504 | B2 * | 7/2003 | Sarson et al. | 493/104 |
| 6,719,192 | B2 | 4/2004 | Barcat et al. | |
| 7,140,532 | B2 * | 11/2006 | Holt et al. | 229/120.13 |
| 8,360,262 | B2 * | 1/2013 | Vovan | 220/522 |
| 2006/0022024 | A1 | 2/2006 | Krimsky et al. | |
| 2010/0102110 | A1 * | 4/2010 | Learn | 229/106 |
| 2012/0292382 | A1 * | 11/2012 | Cai et al. | 229/404 |

* cited by examiner

CONTAINER HAVING A FOLDABLE SUPPORT AND LID

BACKGROUND

1. Field of the Disclosed Subject Matter

The present disclosed subject matter relates to a food container for packaging and serving of food items, such as chicken nuggets, french fries, and other bite-size foods. Particularly, the present disclosed subject matter is directed to a container for holding food items, wherein the container has a lid moveable between open and closed positions. With the lid in the closed position, the container serves as a secure and reliable packaging carton, although the lid can be configured to allow for venting of hot food items if desired. In the open position, the lid provides a support for a receptacle containing a condiment or the like for dipping of food product contained within the container.

2. Description of Related Art

A variety of food items, such as french fries, onion rings, chicken nuggets, popcorn shrimp, and other bite-size foods, are often served from small paperboard containers. These food containers can be pouch-shaped, such as commonly used for french fries, or can be box-shaped and have a lid to contain the food item, such as deli items or the like.

A number of food products are often dipped into sauces or condiments, such as ketchup, mustard, or mayonnaise, before consumption. Many food service establishments provide bulk containers of these condiments and small paper or plastic cups into which the condiment can be dispensed. Alternatively, the condiments may come prepackaged in a sealed container.

If the food product is consumed by a person while seated at a table, the condiment containers can be placed on the table. However, if a person wishes to walk with the container or to eat the food product while driving a vehicle, the use of a condiment becomes more difficult. Both the condiment cup and food container must be held in one hand while the other hand grasps an item of food and dips it in the condiment.

Various attempts have been made to address this problem by providing food containers with compartments for holding a condiment. For example, U.S. Pat. No. 5,875,957 to Yocum and U.S. Pat. No. 5,720,429 to Cordle show containers having interior pockets that can be filled with condiments. However, pockets such as these can be inadvertently squeezed, leading to condiment spills either into the container or onto the user. These pockets also make the containers more difficult to assemble and more costly to produce. U.S. Pat. No. 5,417,364 to Shaw and U.S. Pat. No. 5,842,631 to Berger show complex folding shelves formed separately from a container and glued or otherwise attached to the container for supporting a condiment receptacle. Such attachments also add to the cost of the container and are more difficult to assemble. In addition, these known techniques do not securely retain a condiment receptacle when the food container is carried by a user or balanced in a moving vehicle. Additional containers that attempt to address these and other problems are provided in U.S. Pat Nos. 6,053,403; 6,216,946; and 6,561,414 to Cai, each of which is incorporated by reference herein in its entirety.

It is also known that certain, food items, such as fried chicken, emit moisture or water vapor along with latent heat stored in the food due to cooking and heating. Some of this latent heat and moisture can condense on and be reabsorbed by the food item itself, making the food item soggy, less crispy, and tough to eat. Also, the water vapor can condense on the interior surfaces of the container and drip down towards the bottom of the container for the bottom pieces of the food item to absorb. If air circulation adjacent to and around the food item is poor, the water reabsorption by the food item increases since the latent heat and the resultant water vapor is further prevented from circulating away from the food item. Further, if air from inside the container not allowed to be exchanged with the air from outside the container, condensation of the water vapor on the inside of the container is more likely. Even if a small amount of water vapor escapes from the food item and condenses, or is prevented from circulating away from the food item, this amount can be enough to make the food item undesirable.

It therefore is desirable to provide a food container with a condiment holder that is integrally formed with a food container and capable of securely retaining a condiment receptacle even when the food container is carried or jarred, along with a secure lid to contain the food item and keep the food item warm yet allow sufficient venting to prevent the food item from becoming soggy or otherwise undesirable.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a food container having a first body portion and a second body portion. The first body portion and the second body portion are joined together to define an interior of the container and a mouth to the interior. The first body portion has a first flap moveable between an open position and a closed position, and the first flap includes a foldable support formed therein to hold a receptacle when in the open position. The second body portion has a second flap moveable between an open position and a closed position, and the second flap includes a tab to engage the first flap in the closed position to form a lid across the mouth of the interior.

As embodied herein, the first flap can include a first flap fold line to fold the first flap to the closed position, wherein the closed position is substantially perpendicular to the first body portion. The first flap can also include at least one aperture at least partially defined by a boundary portion extending below the first flap fold line. The second flap can engage the at least one aperture in the closed position, and the at least one aperture can permit venting below the first flap fold line in the closed position. The at least one aperture can be further defined in the lid, and the second flap can be configured to flexibly cover a selectable portion of the at least one aperture in the lid to adjust an amount of venting from the lid.

In some embodiments, the first flap can also include a rim surrounding at least a portion of the foldable support in the open position.

In some embodiments, the foldable support can include a first support portion and a second support portion, and the first support portion can be substantially perpendicular to the second support portion in the open position. One of the first support portion or the second support portion can be substantially trapezoidal, and the other support portion can be substantially rectangular. The foldable support can also include a third support portion disposed between the first support portion and the second support portion. The third support portion can be substantially parallel to one of the first support portion or the second support portion in the open position and can be substantially parallel to the other support portion in the closed position. The third support portion can also include a hinge.

Additionally or alternatively, the first flap can include a first aperture and a second aperture, and the foldable support can be disposed between the first aperture and the second aperture. The second flap can include a first tab score line and a second tab score line, and the first tab score line and second tab score line can extend from the tab flap edge to an inner portion of the at least one flap including the tab and can define the tab. The first tab score line and the second tab score line can each have a first score portion and a first bend, and the tab can include a first fold line defining a first tab lock flap and a second fold line defining a second tab lock flap. The first fold line can extend from the first tab score line first bend in the direction of the first tab score line first score portion, and the second fold line can extend from the second tab score line first bend in the direction of the second tab score line first score portion. In the closed position, the first tab lock flap and the second tab lock flap can each engage a portion of a corresponding one of the first aperture and the second aperture to secure the lid.

Furthermore, the first body portion and the second body portion can each have at least one side flap, and the first body portion and the second body portion can be joined together along at least a portion of each side flap to define opposing side walls of the container. The first flap and the second flap can each engage at least one of the opposing side walls in the closed position.

In some embodiments, the container can include a base portion, and the base portion can have at least one base flap extending between the first body portion and the second body portion. At least one of the first body portion or the second body portion can include a flap base proximate the corresponding first flap or second flap, and the flap base can have a varied width to define a venting aperture when the corresponding first flap or second flap is in the closed position.

The disclosed subject matter also includes a unitary blank for forming a food container including a first body portion and a second body portion aligned along a longitudinal axis. The first body portion and the second body portion each have a base edge, and a base portion extends between the first body portion base edge and the second body portion base edge. The first body portion base edge is at least partially defined by a first body portion base fold line, and the second body portion base edge is at least partially defined by a second body portion base fold line. The first body portion includes a first flap longitudinally opposite the first body portion base edge, and the first flap is defined by at least one first flap fold line. The second body portion includes a second flap longitudinally opposite the second body portion base edge, and the second flap is defined by at least one second flap fold line. At least one of the first flap or the second flap has a foldable support formed therein. The foldable support is joined to the at least one of the first or second flap by a foldable support flap fold line, and the foldable support is joined to a corresponding one of the first body portion or the second body portion at a foldable support body fold line. At least one of the first flap or the second flap includes a tab, and the tab is defined by a first tab score line and a second tab score line. The first tab score line and the second tab score line extend from a tab flap edge to an inner portion of the at least one of the first flap or the second flap including the tab.

Furthermore, the at least one flap having the foldable support formed therein can also include a support flap edge. The support flap edge can at least partially define a rim surrounding at least a portion of the foldable support.

In some embodiments, the foldable support can include a first support portion and a second support portion, and the first support portion and the second support portion can be joined at a support portion fold line. One of the first support portion or the second support portion can be substantially trapezoidal and the other support portion can be substantially rectangular. The foldable support can also include a third support portion disposed between the first support portion and the second support portion. The third support portion can be joined to the first support portion at a third support portion first fold line, and the third support portion can be joined to the second support portion at a third support portion second fold line. The second support portion can be at least partially defined by substantially parallel second support portion score lines. The second support portion score lines formed in the corresponding one of the first body portion or the second body portion can be perpendicular to the foldable support body fold line.

Additionally, the at least one flap having the foldable support formed therein can include a first aperture and a second aperture. The foldable support can be disposed between the first aperture and the second aperture. The tab can include a first tab lock flap and a second tab lock flap, and the first tab lock flap and the second tab lock flap can each engage a portion of a corresponding one of the first aperture and the second aperture in the closed position to secure the lid.

In some embodiments, the first body portion and the second body portion can each have at least one side flap defined by at least one side flap fold line. The base portion can have at least one base flap defined by at least one base flap fold line.

Additionally, at least one of the first body portion or the second body portion can include a flap base proximate the corresponding first flap or second flap. The flap base can have a varied width to define a venting aperture when the corresponding first flap or second flap is in the closed position.

Furthermore, at least one of the first flap or the second flap can include a notch. The notch can be configured to accommodate at least a portion of the other flap of an adjacent similarly configured blank on a sheet of blank material.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Figure 1:
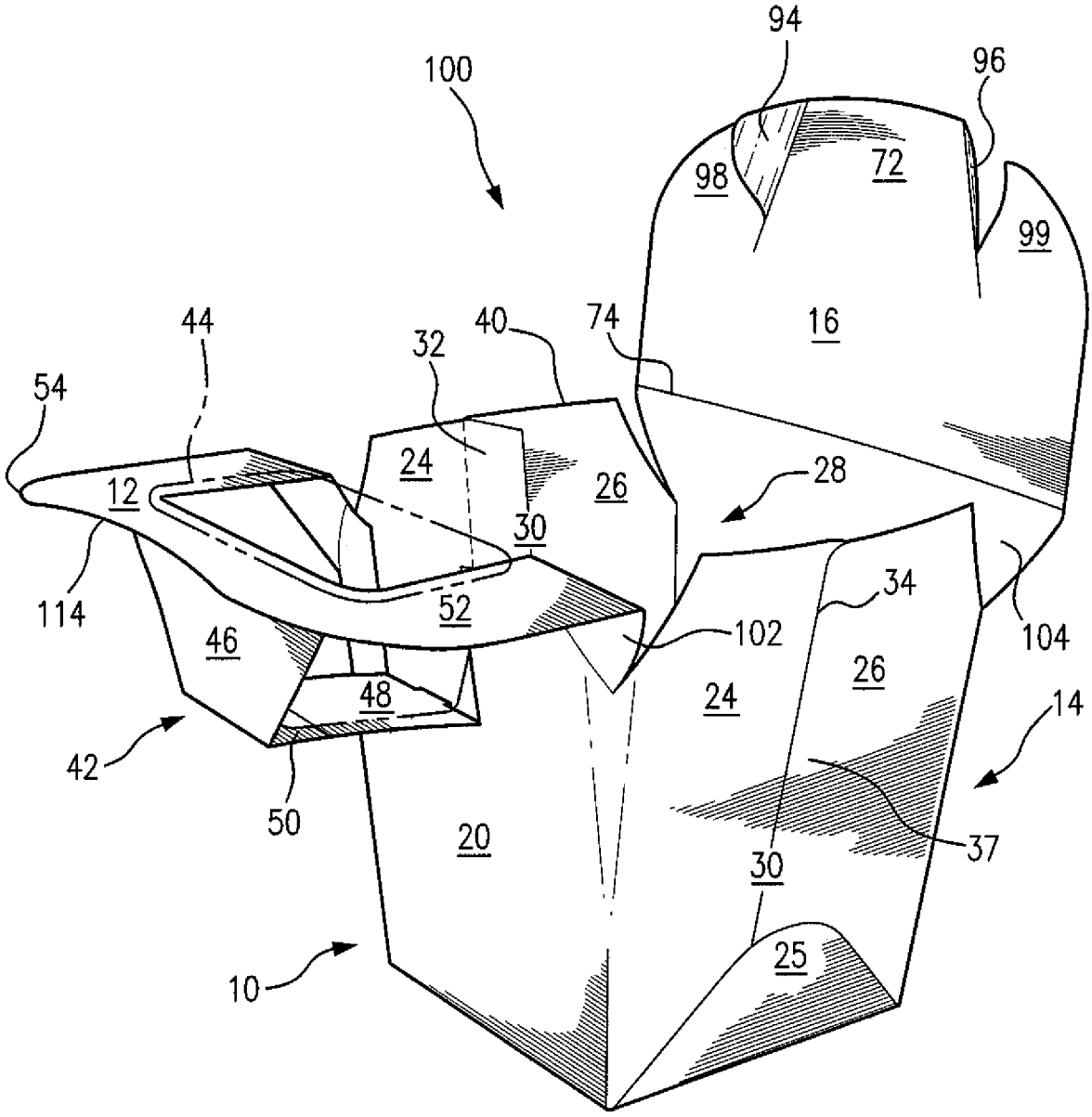
FIG. 1 is a perspective view of an exemplary embodiment of a food container in accordance with the disclosed subject matter, shown in a partially open configuration.
Figure 2:
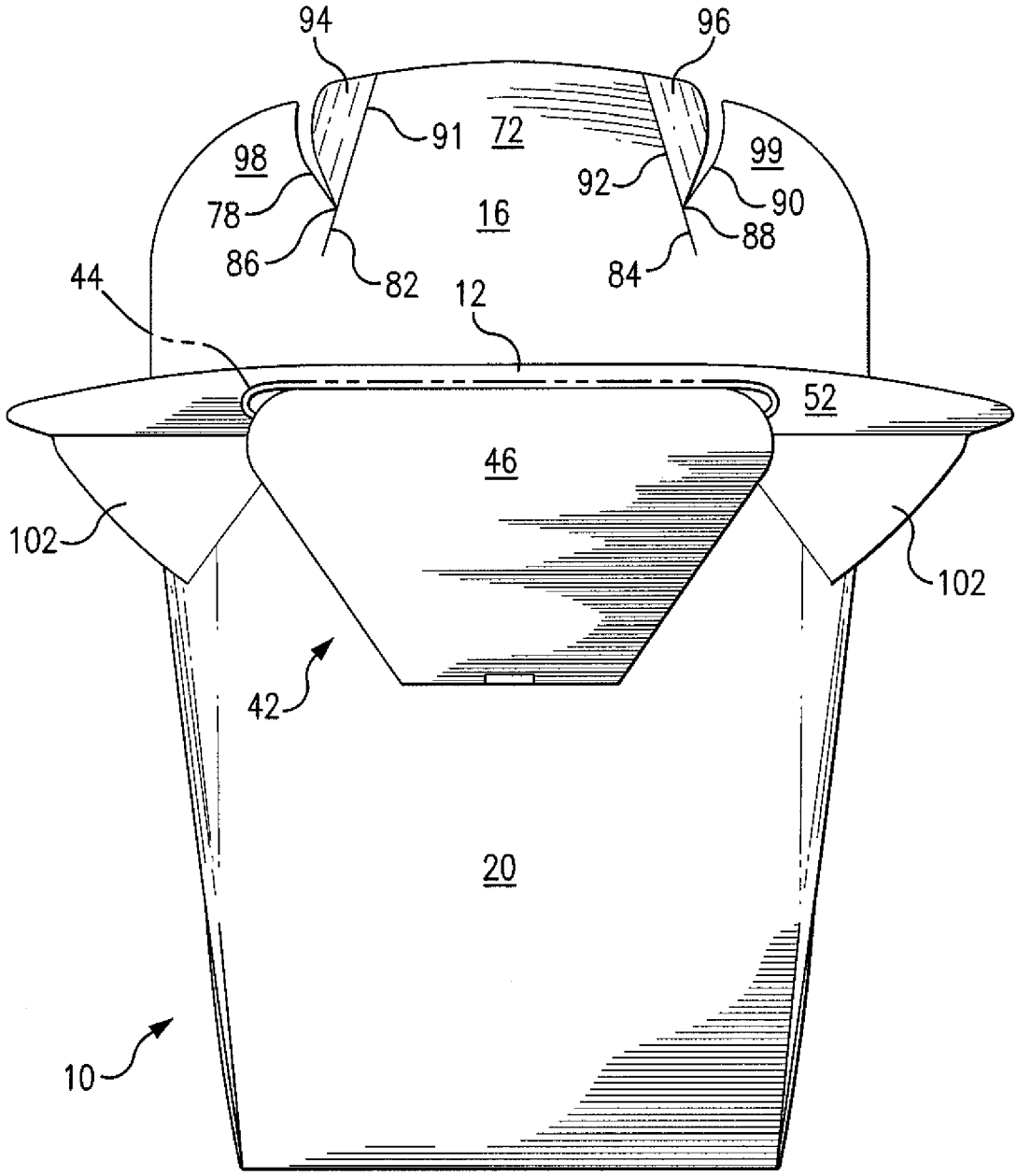
FIG. 2 is a front view of the container of FIG. 1.
Figure 3:
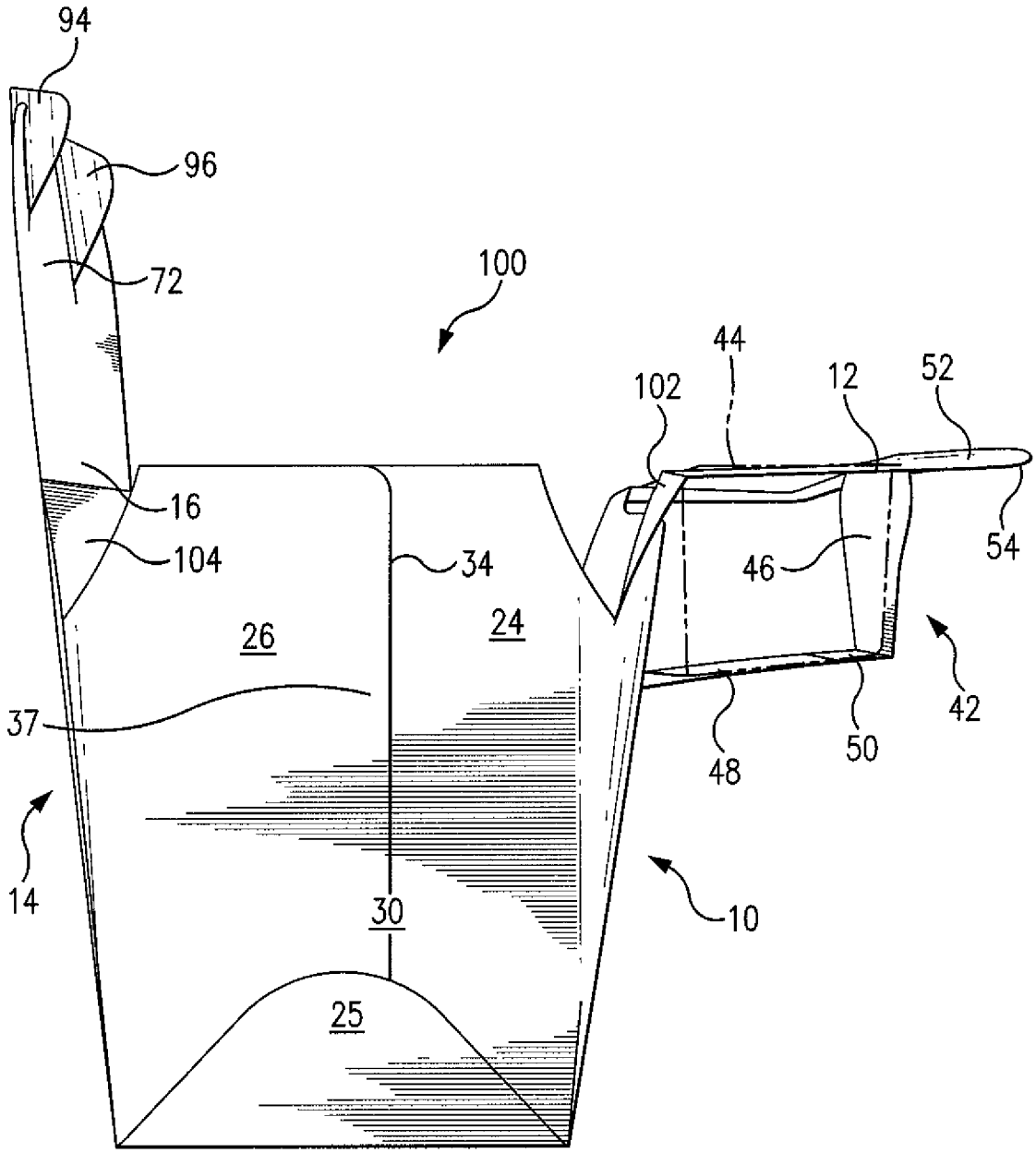
FIG. 3 is a side view of the container of FIG. 1.
Figure 4:
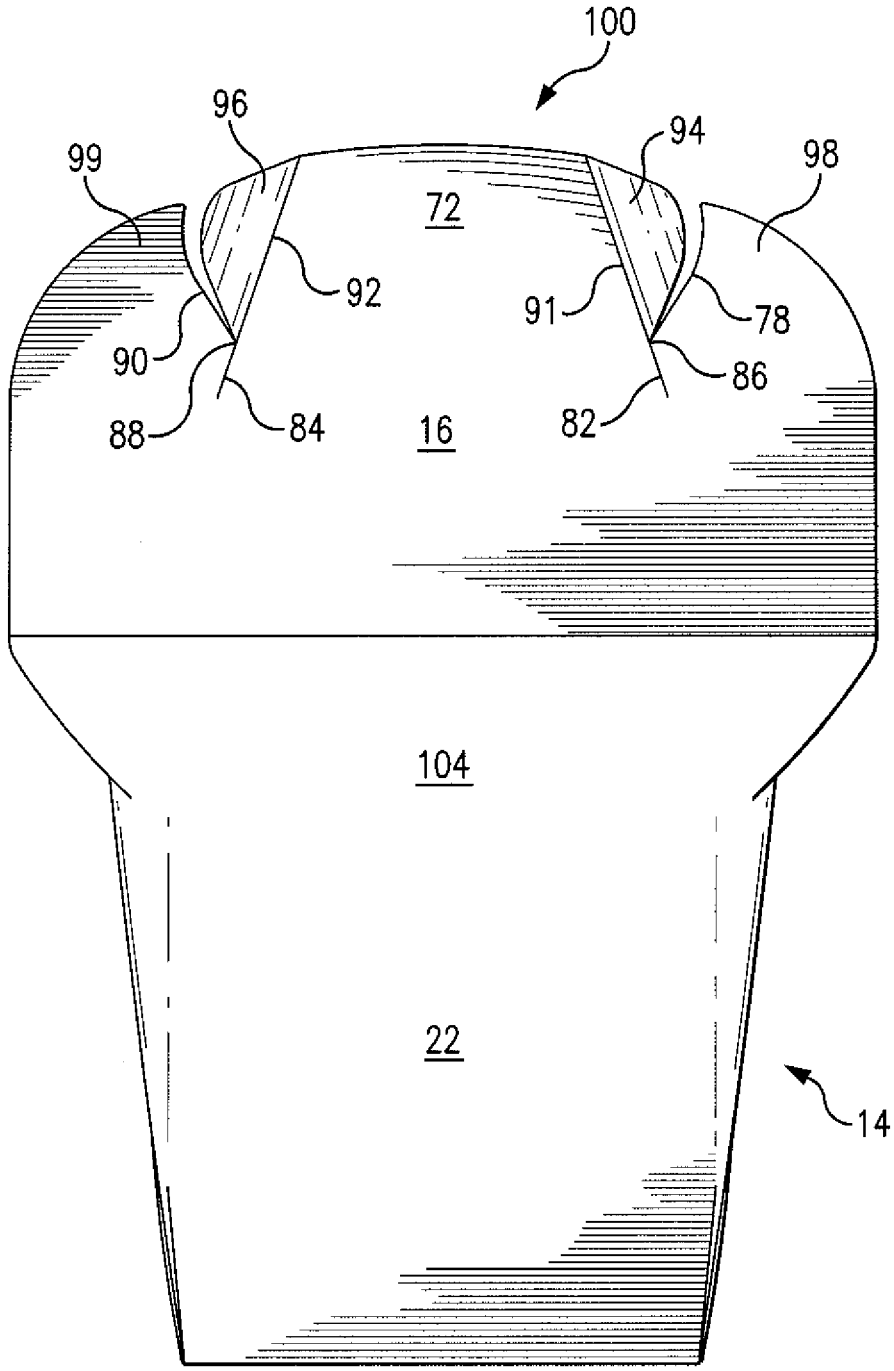
FIG. 4 is a rear view of the container of FIG. 1.

Reference will now be made in detail to the various exemplary embodiments of the disclosed subject matter; exemplary embodiments of which are illustrated in the accompanying drawings. The structure and corresponding method of operation of the disclosed subject matter will be described in conjunction with the detailed description of the system.

The apparatus and methods presented herein may be used for transport of food items and other perishable and nonperishable products. The disclosed subject matter is particularly suited for packaging and serving of food items, wherein the container can convert between a closed position, in which the contents of the container are enclosed, and an open configuration, in which the container includes a support for a receptacle containing a condiment and allows for consumption of the food product and dipping of the food product into the condiment. Also, the container can allow for venting of the food items in the closed position.

In accordance with the disclosed subject matter herein, the container generally includes a first body portion and a second body portion. The first body portion has a first flap moveable between an open position and a closed position, and the second body portion has a second flap moveable between an open position and a closed position. The first body portion and the second body portion are joined together to define an interior of the container and a mouth to the interior. In the closed position, the first flap and the second flap together form a lid across the mouth of the interior, and at least one of the first flap or the second flap include a tab to engage the other flap in the closed position. Furthermore, at least one of the first flap or the second flap includes a foldable support formed therein to hold a receptacle when in the open position. A unitary blank for forming a food container is also provided.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the container in accordance with the disclosed subject matter are shown in FIGS. 1-10. The container is suitable for use with a wide variety of hot and cold food items, such as fruit slices, chips, bread sticks, candies, and other suitable bite-size food items, particularly if typically consumed with a dipping sauce or the like. However, the container disclosed herein is particularly suitable and beneficial for use with hot, prepared food items, such as chicken nuggets, french fries, onion rings, and popcorn shrimp, that are typically served with a condiment for dipping, such as ketchup, mustard, mayonnaise, or vinegar, wherein the container can be used for storing, transporting, and/or re-using such food items as well as serving the food items and allowing for dipping of the food items into the condiment. Further, the container desirably can have insulating properties to assist in maintaining the temperature of food contained therein as well as venting properties to allow for removal of excess moisture. For purpose of illustration, and not limitation, reference will made herein to a container intended to contain food items and hold a receptacle for a condiment. Additionally, as used herein, the terms "front," "rear," "side," "top," and "bottom" are used for the purpose of illustration only, and not limitation. That is, it is recognized that the terms "front," "rear," "side," "top," and "bottom" are interchangeable and are merely used herein as a point of reference.

For purpose of illustration, and not limitation, reference is made to the exemplary embodiment of a container 100 shown in FIGS. 1-10. Additionally, for purpose of understanding, reference is made in conjunction to the blank 200 of FIG. 11, which forms the container 100 of FIGS. 1-10. As shown in FIGS. 1-10, the container 100 generally includes a first body portion 10 and a second body portion 14 joined to form an interior 28. The interior 28 of the container is defined at least in part by a front wall panel 20 of the first body portion 10 opposing a rear wall panel 22 of the second body portion 14. A top edge of each of the front wall panel 20 and rear wall panel 22 defines, at least in part, a mouth 40 to the interior 28 of the container 100.

As embodied herein, the container 100 further includes opposing side walls 30. For example and without limitation, the first body portion 10 and the second body portion 14 each having at least one side wall panel 24, 26. Furthermore, the first body portion 10 and the second body portion 14 are joined together along at least a portion 32, 37 of each side wall panel 24, 26 to define opposing side walls 30 of the container 100. With reference to the blank 200 of FIG. 11, first side wall panels 24 of the first body portion 10 can be folded inward toward the front wall panel 20 along first side wall panel fold lines 27, and second side wall panels 26 of the second body portion 14 can be folded inward toward the rear wall panel 22 along second side wall panel fold lines 29 to be substantially perpendicular to the front wall panel 20 and the rear wall panel 22, respectively. The first and second side wall panel fold lines 27, 29 can extend along only a portion of the front and rear wall panels 20, 22 to form at least partially rounded edges joining the front and rear wall panels 20, 22 with the side walls 30. The first body portion 10 can be folded inward towards the base portion 18 along the first body portion base edge 33, and the second body portion 14 can be folded inward towards a base portion 18 along the second body portion base edge 35 to cause portions of side wall panels 26 of the second body portion 14 to overlap portions of side wall panels 24 of the first body portion 14. Overlapping edge portions 32, 37 of the side wall panels 24, 26 can be adhesively bonded to form opposed side walls 30. To enhance the adhesive bonding at side seams 34 of the side walls 30, particularly in those instances wherein the faces of the wall panels can be coated with a moisture barrier at the point of overlap, the overlap forming edge portions of the side wall 26 can, as shown in the blank 200 of FIG. 11, have linear lines 36 formed therein which cut through the moisture barrier without disruption of the corresponding opposed surface of the wall panel.

Figure 5:
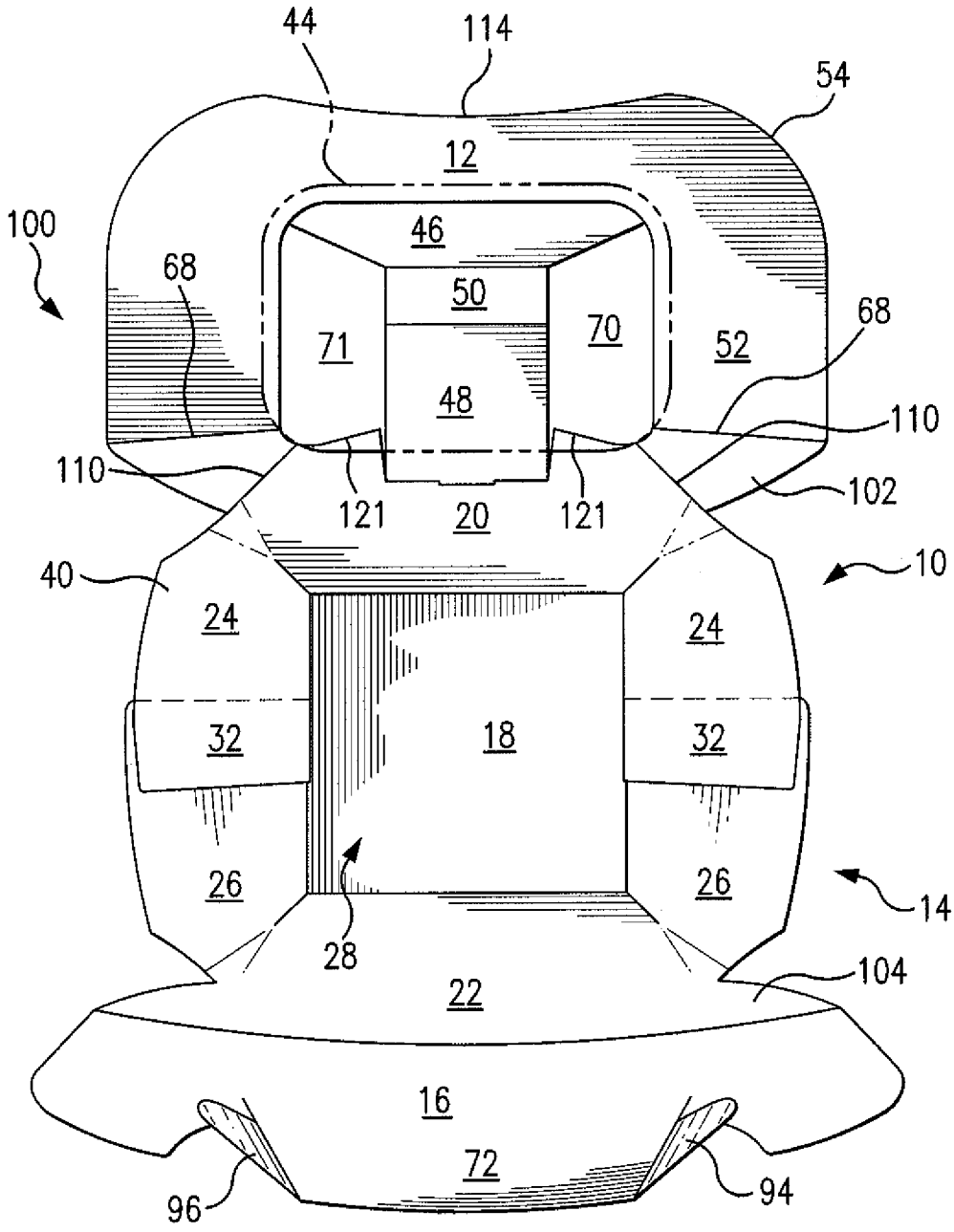
FIG. 5 is a top view of the container of FIG. 1.
Figure 6:
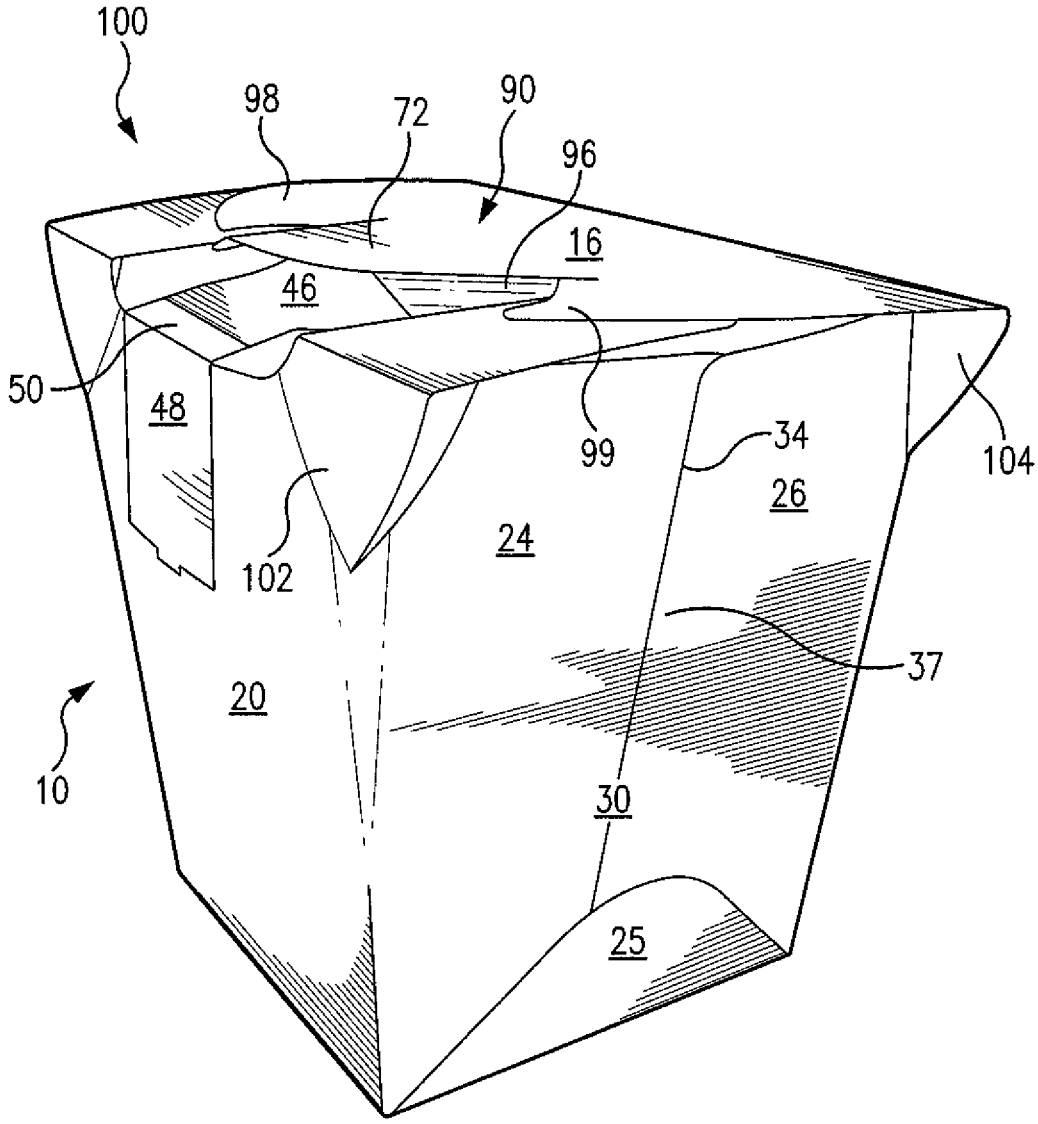
FIG. 6 is a perspective view of the container of FIG. 1, shown in a closed configuration.

Furthermore, the container 100 can include a base portion 18. As best shown in FIG. 5, the base portion 18 is disposed between the first body portion 10 and the second body portion 14, or alternatively, a base portion 18 can be integral with either one or both of the first body portion 10 and the second body portion 14. The base portion 18 can define a bottom 23 of the interior 28. The base portion 18 can further have base portion flaps 25, which can be folded and joined, for example using an adhesive, to a corresponding one of the side walls 30 to add additional support to the side walls 30. An opening or mouth 40 of the container 100 is formed by the first body portion 10 and the second body portion 14, allowing access into the interior 28 of the container 100, and the mouth can be opposite the base portion 18.

In accordance with the disclosed subject matter, the first body portion 10 has a first flap 12, and the second body portion 14 has a second flap 16, wherein the first flap 12 and the second flap 16 are movable between a open position (as shown for example in FIGS. 1-5) and a closed position (as shown for example in FIGS. 6-10). Although FIGS. 1-5 depict second flap 16 in a generally vertical orientation, it is understood that the second flap 16 can be disposed at a greater angle relative the mouth 40 to the interior 28.

At least one of the flaps 12, 16 has a foldable support 42 formed therein. For example, and as embodied herein, foldable support 42 is depicted in first flap 12, although it is recognized that foldable support 42 can be formed in second flap 16 or both flaps 12, 16. In the open position, as shown for example in FIGS. 1-5, foldable support 42 is formed in the first flap 12 to hold a receptacle 44. As best shown in the blank 200 of FIG. 11, the foldable support 42 is partially surrounded by a rim 52, the outer portion of which can be defined at least in part by a substantially arcuate support flap edge 54. Rim 52 of the first flap 12 is connected at its ends to front body portion 10 by first flap fold lines 68, which allow first flap 12 to fold relative to the front wall panel 20, and the first flap 12 can also fold along a third support portion second fold line 64, which is substantially aligned with first flap fold lines 68 to further define the flap, as shown in FIG. 11.

Figure 11:
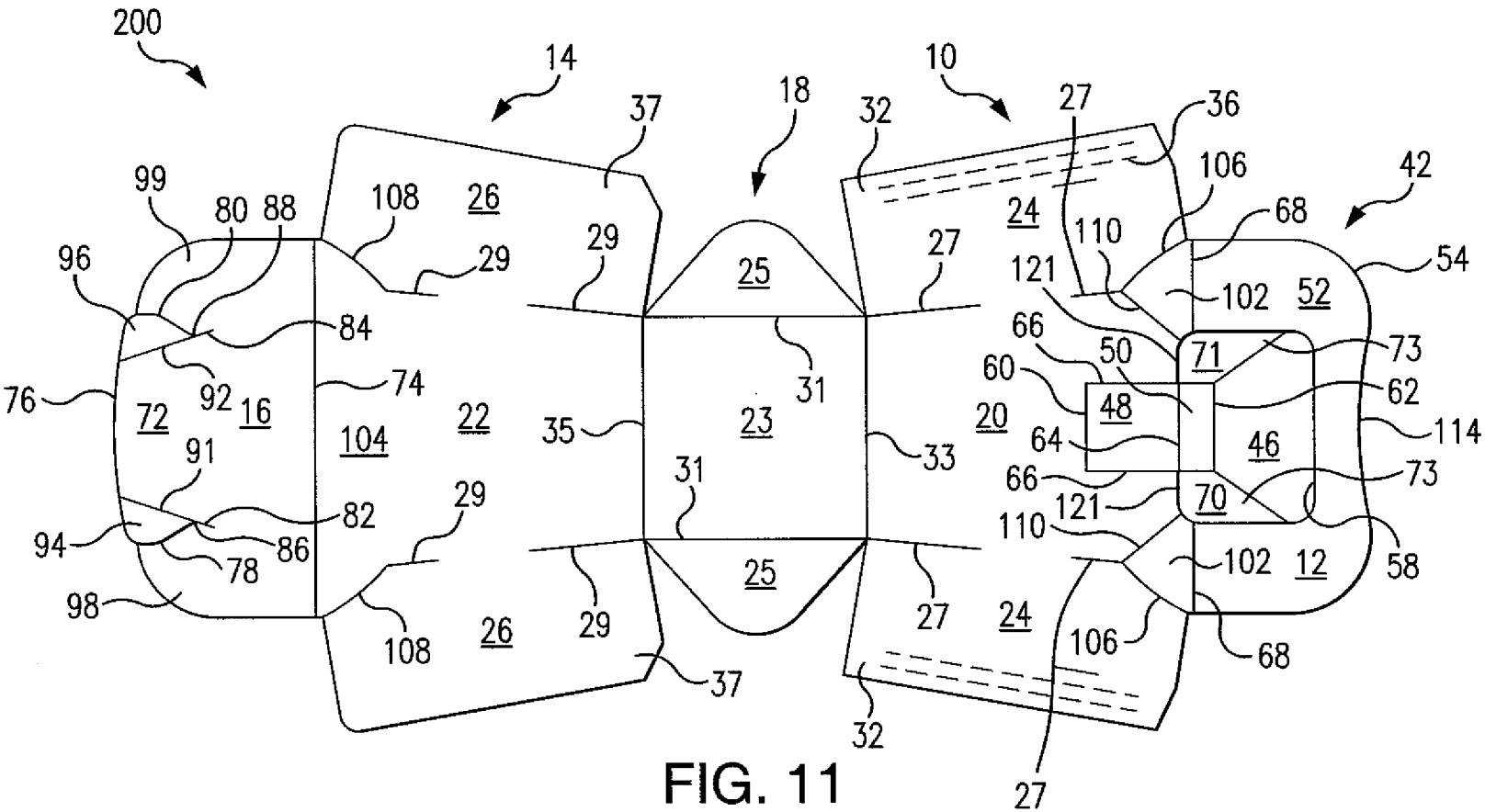
FIG. 11 is a plan view of an exemplary embodiment of a unitary blank for forming a food container of FIGS. 1-10 in accordance with the disclosed subject matter.
Figure 12:
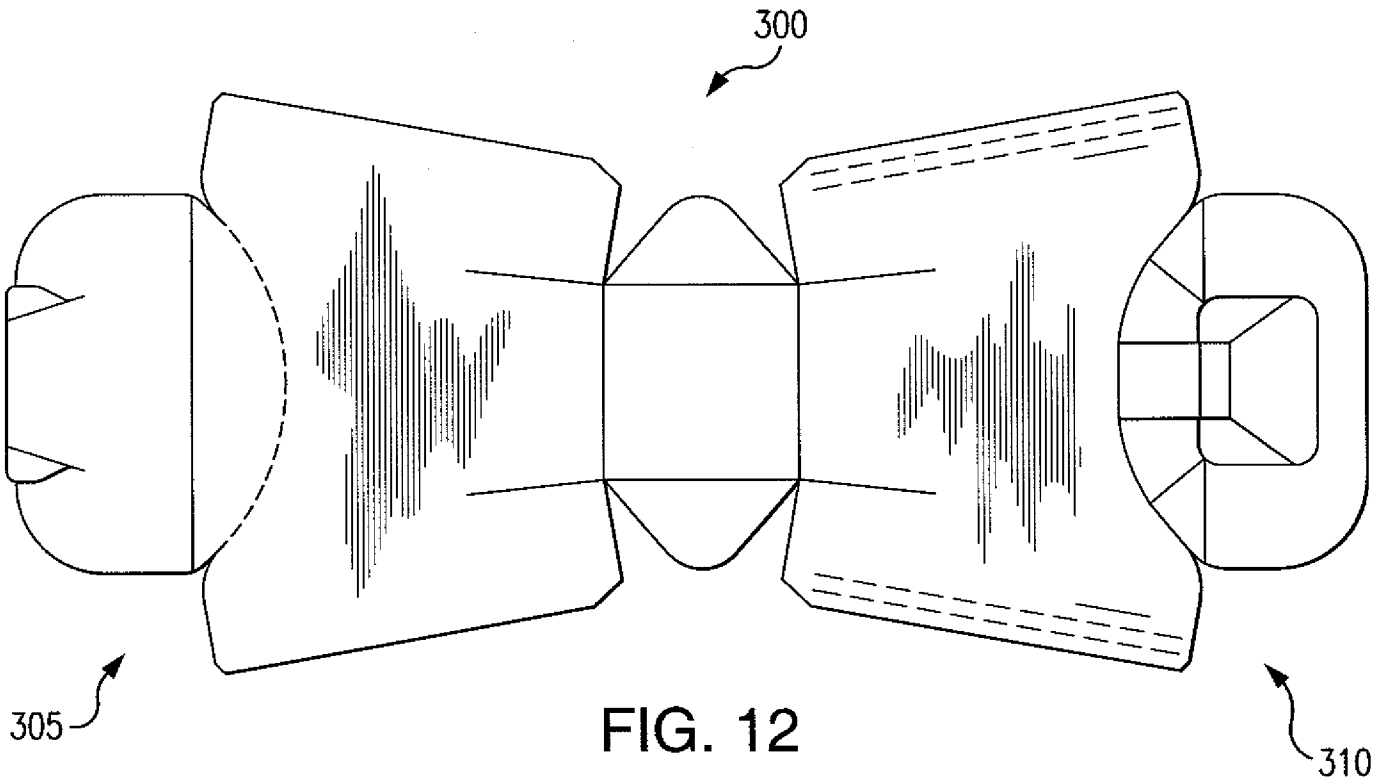
FIG. 12 is a plan view of an alternative embodiment of a unitary blank for forming a food container having alternative body portion configurations in accordance with the disclosed subject matter.
Figure 13:
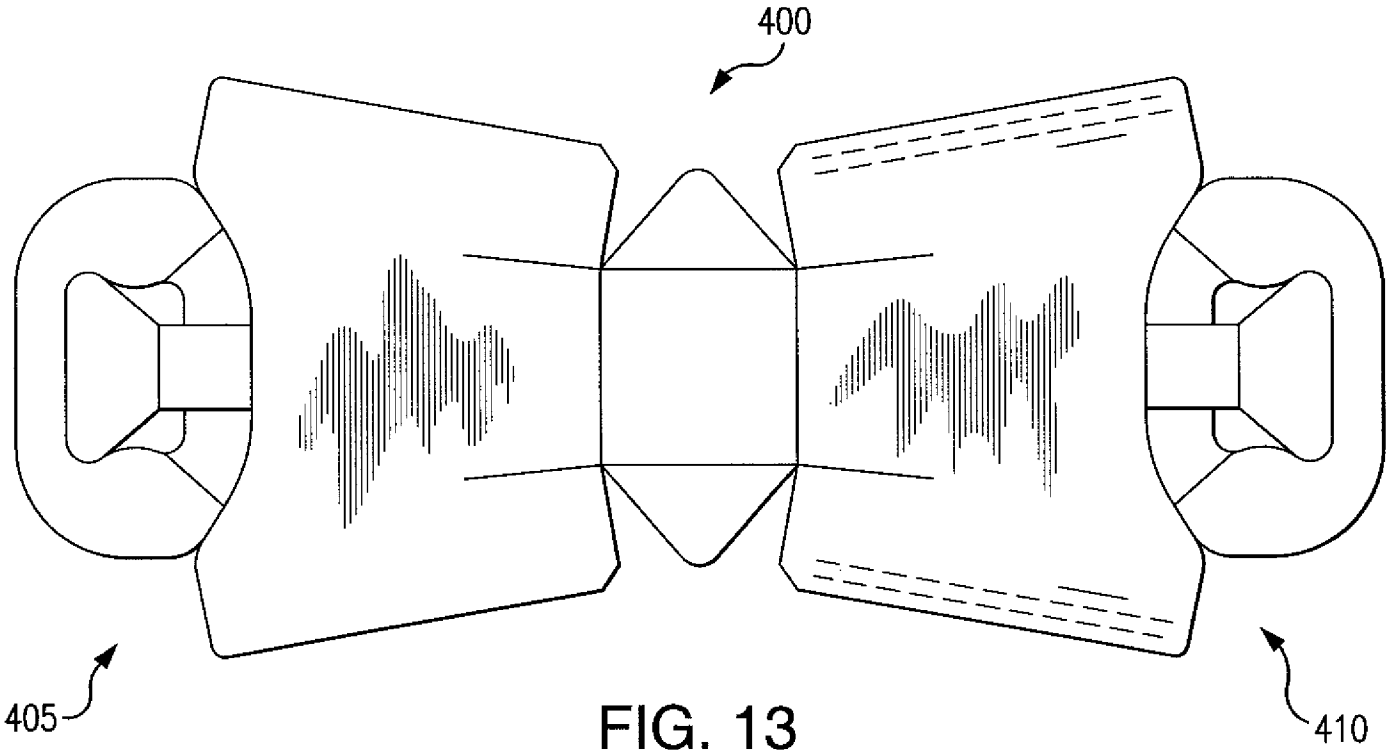
FIG. 13 is a plan view of an alternative embodiment of a unitary blank for forming a food container having a foldable support on each flap in accordance with the disclosed subject matter.
Figure 14:
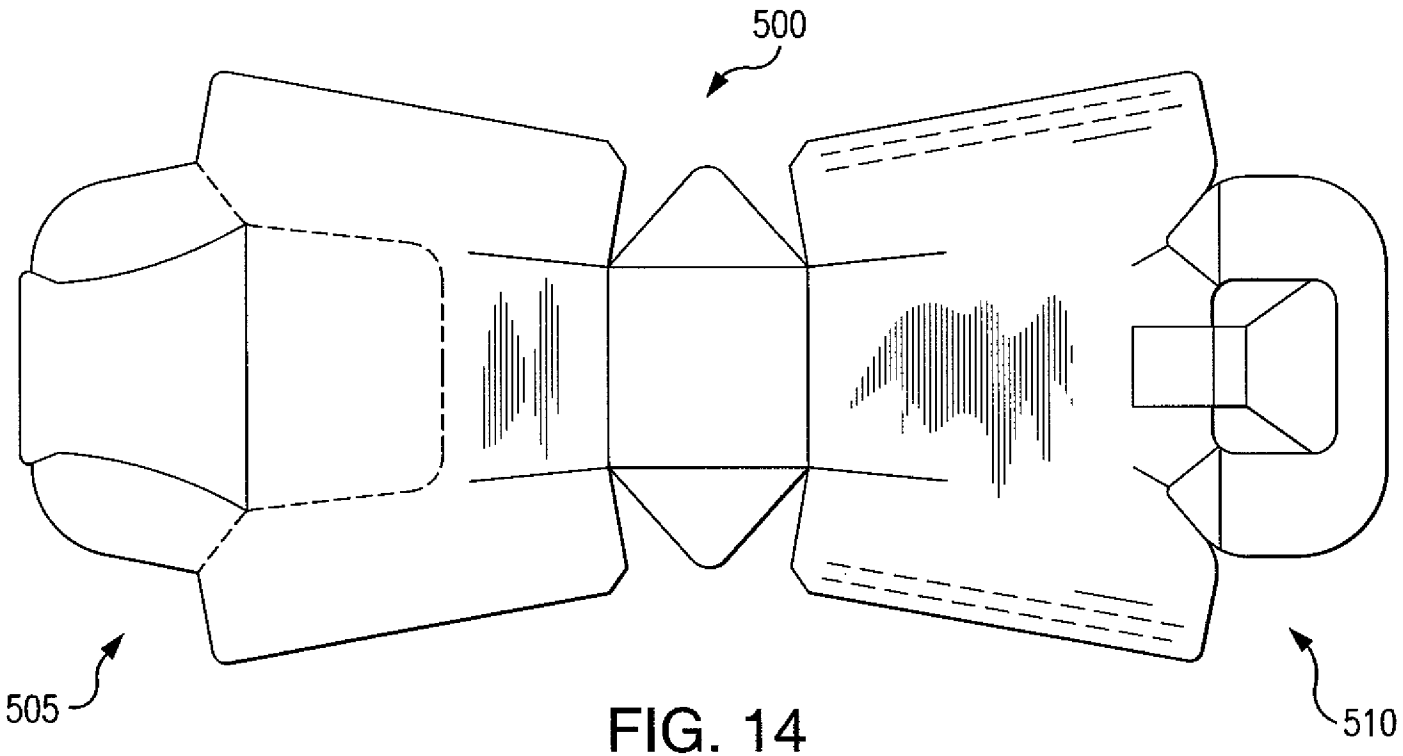
FIG. 14 is a plan view of an alternative embodiment of a unitary blank for forming a food container having an alternative tab configuration in accordance with the disclosed subject matter.
Figure 15:
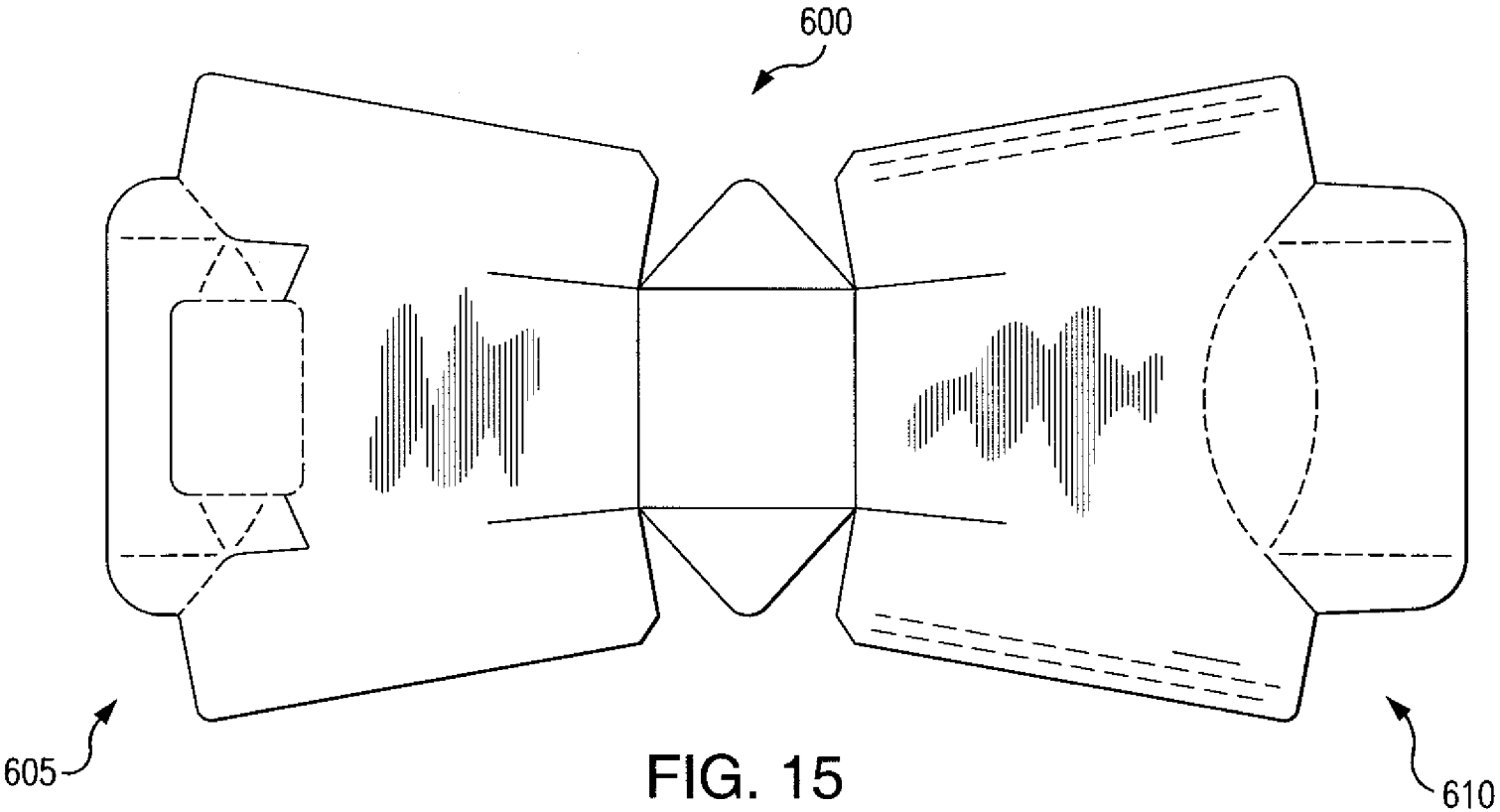
FIG. 15 is a plan view of an alternative embodiment of a unitary blank for forming a food container having an alternative foldable support configuration and an alternative tab configuration in accordance with the disclosed subject matter.
Figure 16:
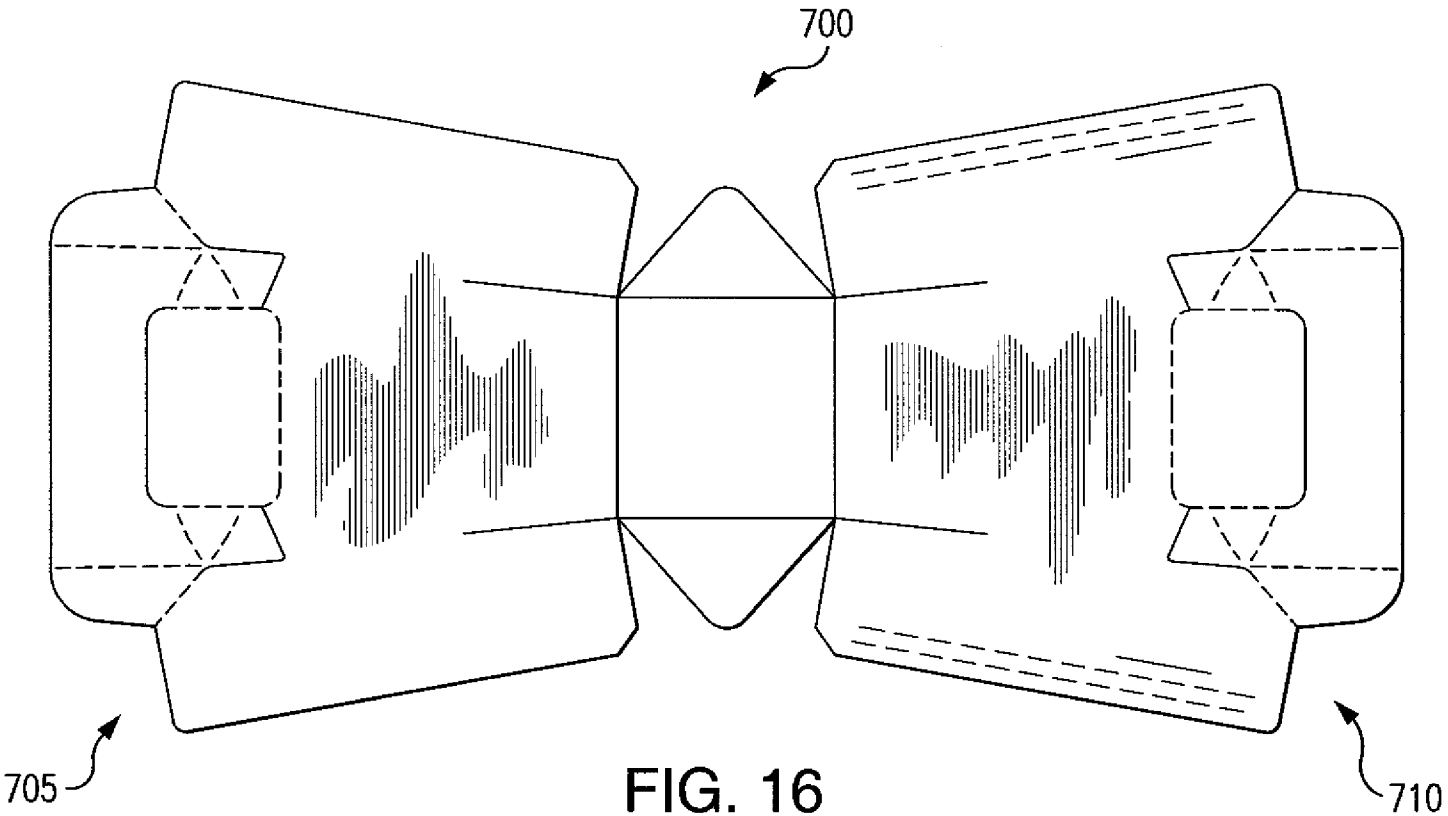
FIG. 16 is a plan view of an alternative embodiment of a unitary blank for forming a food container having the foldable support of FIG. 15 on each flap in accordance with the disclosed subject matter.

As depicted in FIGS. 1-10, and with reference to the blank 200 of FIG. 11, foldable support 42 is generally divided into three sections: a substantially trapezoidal first support portion 46 joined to the rim 52 at a foldable support flap fold line 58, a rectangular second support portion 48 joined to the front wall panel 20 at a foldable support body fold line 60, and a third support portion 50, which can be joined to the first support portion 46 at a third support portion first fold line 62 and the second support portion 48 at a third support portion second fold line 64. The second support portion 48 can be further joined to the front wall panel 20 by parallel second support portion perforated lines 66, which extend perpendicular to and between the foldable support body fold line 60 and the third support portion second fold line 64.

To deploy the foldable support 42, the first flap 12 is folded outward from the interior 28 of the container 100, such as by moving the rim 52 away from the interior 28 until the first flap 12 is about perpendicular to the front wall panel 20. When the foldable support 42 is first deployed, the second support portion 48 can be separated from the front wall 20 of the first body portion 10 by tearing along the second support portion perforated lines 66. This allows the foldable support 42 to pivot about foldable support body fold line 60 while also pivoting about the foldable support flap fold line 58. At the same time, the second support portion 48 and third support portion 50 pivot relative the first support portion 46 about the third support portion first fold line 62 to deploy the foldable support 42. When the first flap 12 reaches a point about perpendicular to the front wall, the first support portion 46 extends down from the rim 52, substantially perpendicular to the rim 52, to define a side wall to support a receptacle 44, and the second support portion 48 and third support portion 50 extend substantially perpendicular from the first support portion 46 to the front wall 20 to form a bottom wall to support a receptacle 44. The third support portion 50 can function as a hinge between the first support portion 46 and the second support portion 48.

To form the closed position of the container 100, as shown in FIGS. 6-10, the first flap is folded inward towards the mouth 40 of the interior 28 of the container 100, such as by moving the rim 52 toward the interior 28 until the first flap 12 is about perpendicular with the front wall panel 20. If the container 100 is provided with side walls 30, the first flap 12 can be disposed to rest on the side walls 30 to cover a portion of the mouth 40. When the first flap 12 is folded inward from the open position to point where the first flap 12 is about parallel to the front wall 20, the foldable support 42 pivots about foldable support body fold line 60 while also pivoting about the foldable support flap fold line 58, and at the same time, the second support portion 48 and third support portion 50 pivot relative the first support portion 46 about the third support portion first fold line 62 until the portions 46, 48, and 50 of the foldable support 42 are aligned substantially in parallel with each other, with the first flap 12, and with the front wall panel 20. As the first flap 12 is folded further inward toward the interior 28 to a point where there first flap 12 is about perpendicular with the front wall 20, the first support portion 46 and the third support portion 50 continue to fold along the third support second fold line 64 until perpendicular to the second support portion 48.

As embodied herein, and as shown in the blank 200 in FIG. 11, first aperture 70 and second aperture 71 can be formed in the first flap 12, with the foldable support 42 disposed between first aperture 70 and the second aperture 71. When the container 100 is in the open position, the first aperture 70 and the second aperture provide a space into which the receptacle 44 can be inserted to be held by the foldable support 42. When the container 100 is in the closed position, the first aperture 70 and the second aperture 71 allow for circulation of air and venting of excess heat and moisture in the container 100. As described below, the first aperture 70 and the second aperture 71 also provide a mating portion to cooperate with a tab 72 formed in the second flap 16 to lock the lid 90 of the container.

The second flap 16 is also movable between an open position (as shown in FIGS. 1-5) an a closed position (as shown in FIGS. 6-10). In the open position, the second flap 16 can be substantially parallel to the rear wall panel 22 or can be angled relative to the rear wall panel 22. The second flap 16 is joined to the rear wall panel 22 by the second flap fold line 74 and is movable between the open position and the closed position by pivoting the second flap 16 about the second flap fold line 74.

Further in accordance with the disclosed subject matter, at least one of the first and second flaps 12, 16 can include a tab. As embodied herein, for illustration and not limitation, the second flap 16 includes tab 72. The tab 72 of the second flap 16 is defined by tab flap edge 76 at the free end of the second flap 16, and a first tab score line 78 and a second tab score line 80, each extending from the tab flap edge 76 to an inner portion of the second flap 16. The first tab score line 78 and the second tab score line 80 each include a first score portion 82, 84 and a first bend 86, 88, and the tab includes a first fold line 91 defining a first tab lock flap 94 and a second fold line 92 defining a second tab lock flap 96. The first fold line 91 extends from the first tab score line first bend 86 in the direction of the first tab score line first score portion 82, and the second fold line 92 extends from the second tab score line first bend 88 in the direction of the second tab score line first score portion 84.

When the first flap 12 and the second flap 16 are in the closed position (as shown in FIGS. 6-10), the first tab lock flap 94 and the second tab lock flap 96 can be inserted into a corresponding slit, or if provided, a corresponding portion 73 of the first aperture 70 and the second aperture 71, respectively, to lock the lid 90. In this position, the first tab lock flap 94 and the second tab lock flap 96 can each be inserted under a portion of the rim 52, with outer portions 98, 99 of the second flap 16 resting on top of a substantially adjacent portion of the rim 52, with a portion of the support flap edge 54 of the rim 52 disposed within the first tab score line 78 and the second tab score line 80. With the first tab lock flap 94 and the second tab lock flap 96 covering a portion 73 of the first aperture 70 and the second aperture 71, the remaining portions of the first aperture 70 and the second aperture 71 are left open to allow for circulation of air and venting of excess heat and moisture in the container 100. The lid 90 can be configured to be closed and locked with one hand by closing the flaps 12, 16 and pressing the tab 72 into the apertures 70, 71.

Figure 7:
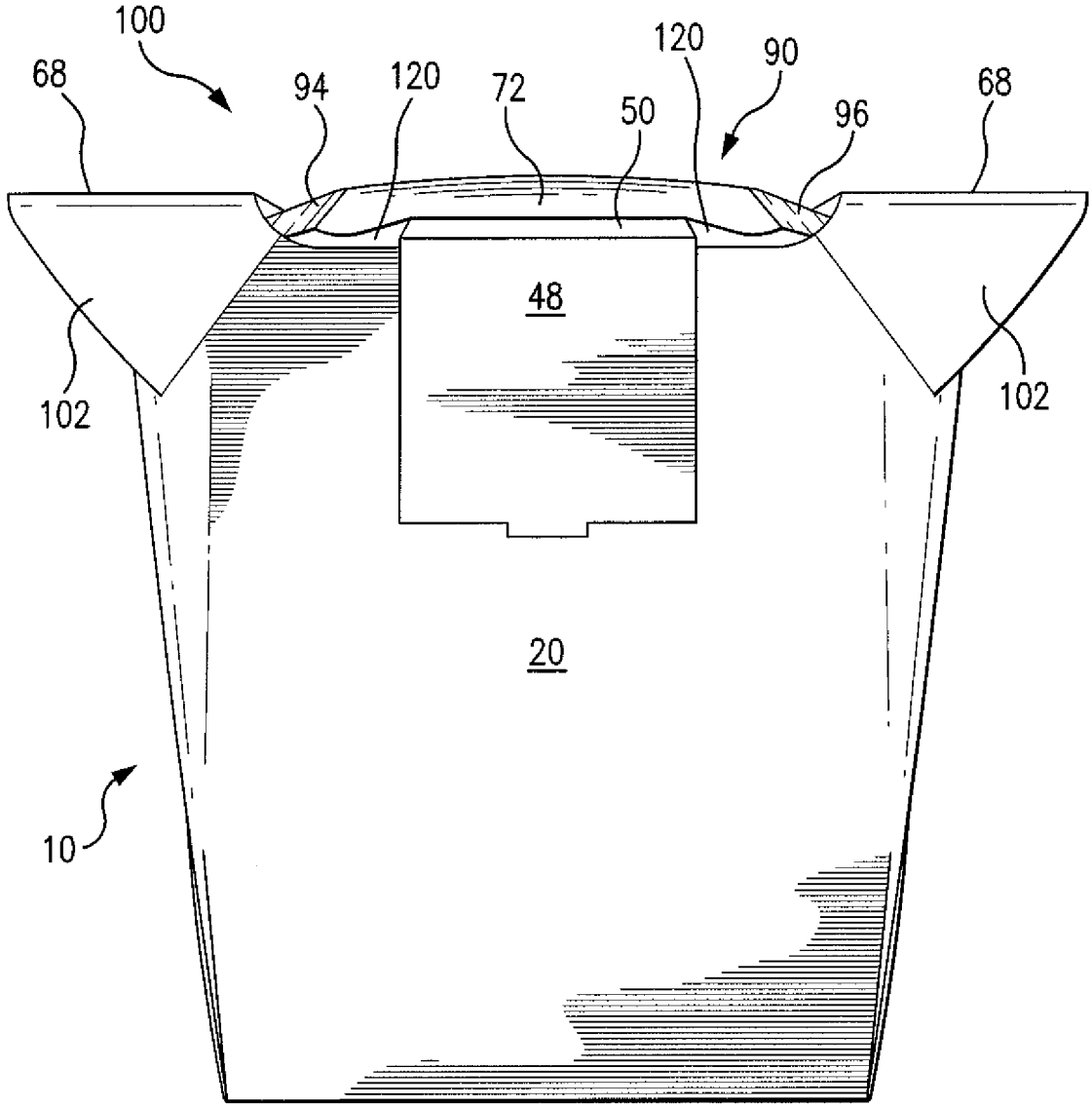
FIG. 7 is a front view of the container of FIG. 6.
Figure 8:
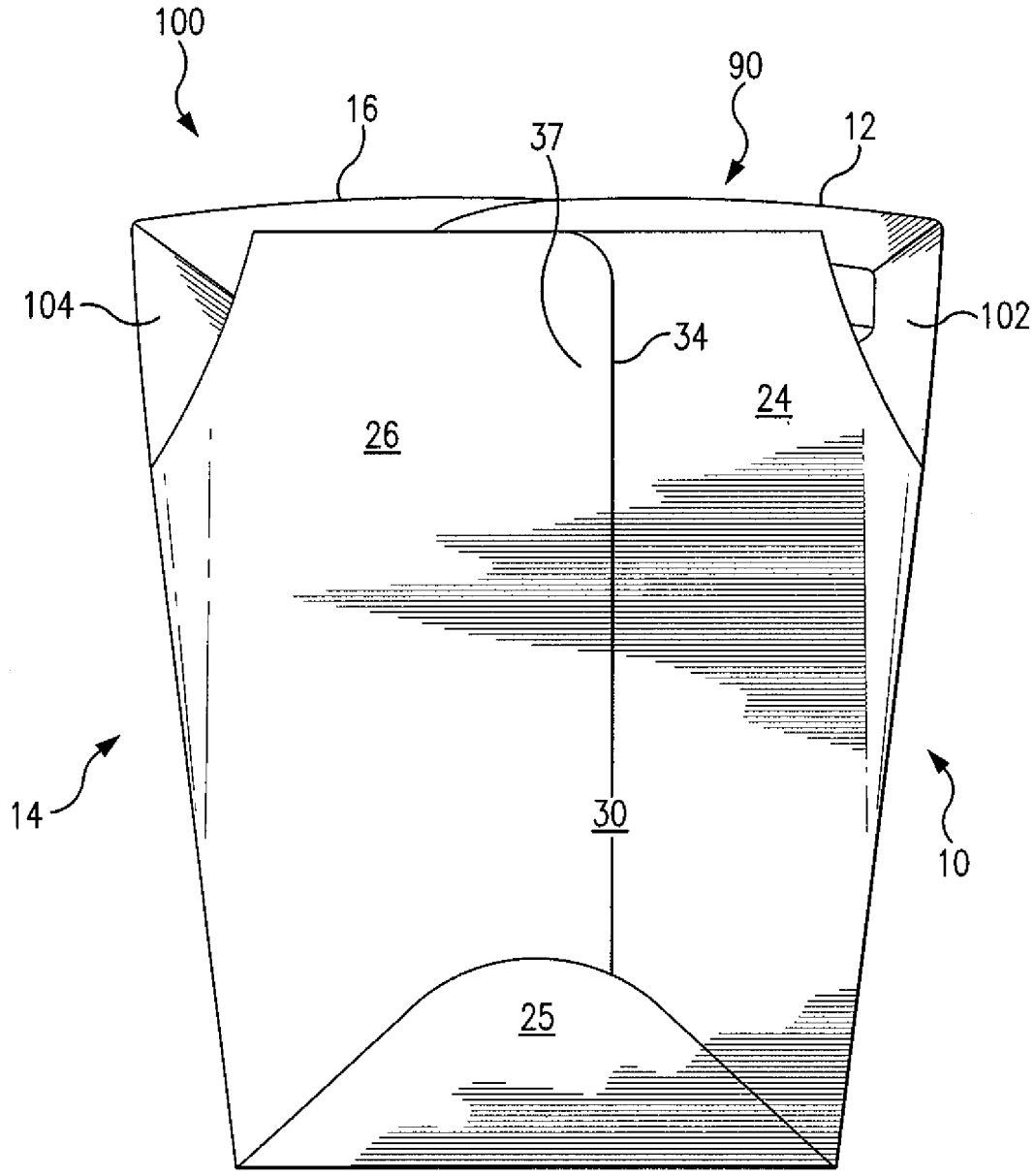
FIG. 8 is a side view of the container of FIG. 6.
Figure 9:
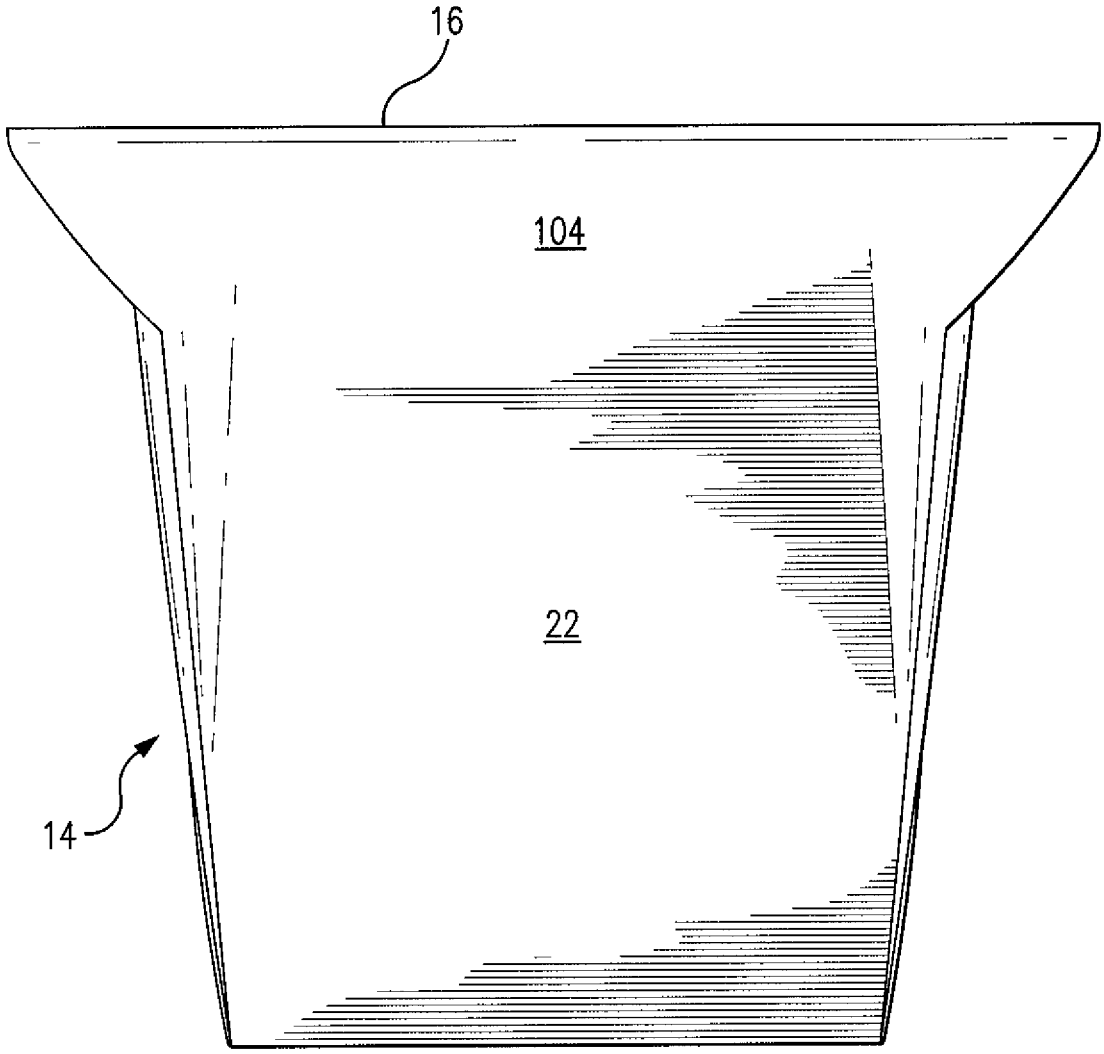
FIG. 9 is a rear view of the container of FIG. 6.
Figure 10:
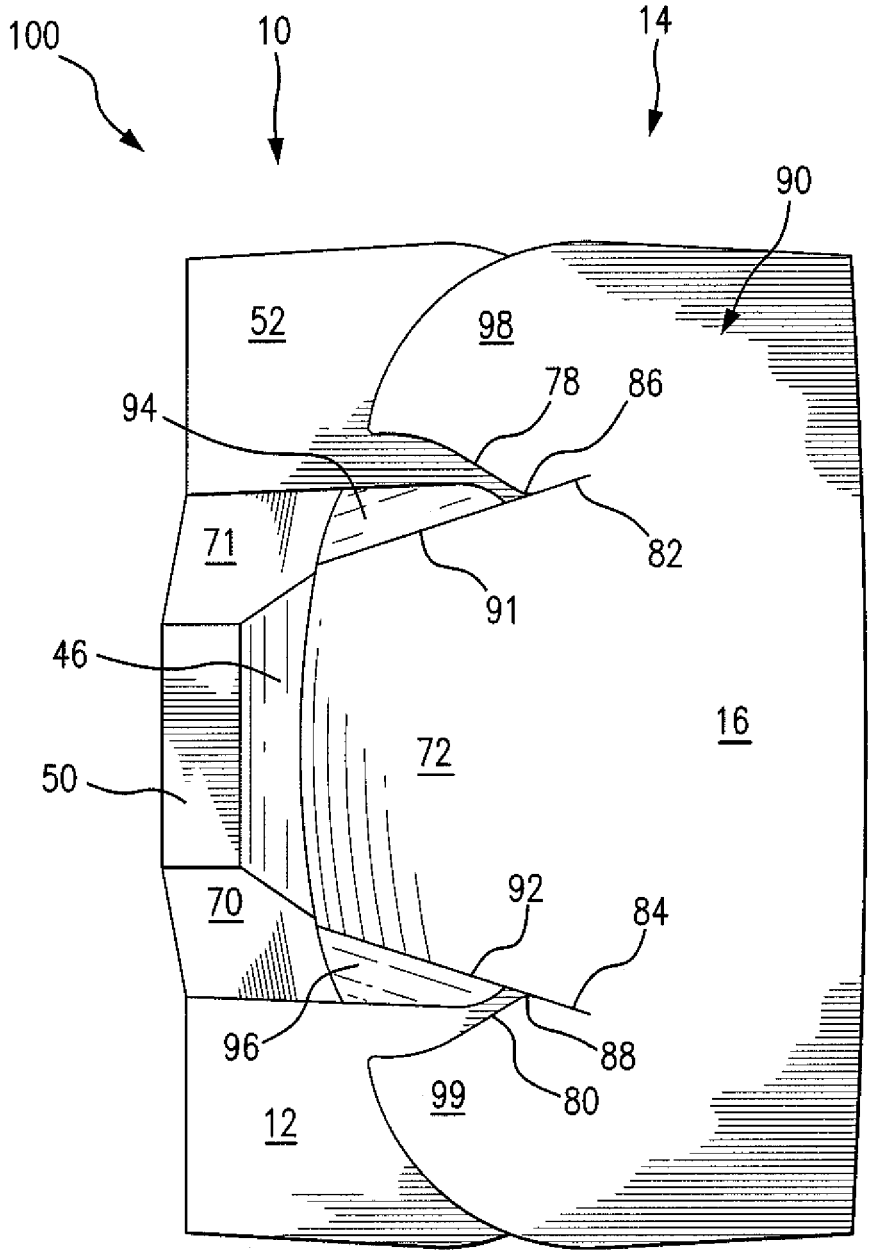
FIG. 10 is a top view of the container of FIG. 6.

Referring now to FIG. 7 and with reference to the blank 200 of FIG. 11, an arcuate edge 121 of the first and second apertures 70, 71 can extend below the first flap fold lines 68 to form a portion 120 of the first and second apertures 70, 71 in the front wall panel 20. The portion 120 of the first and second apertures 70, 71 allows for circulation of air and venting of excess heat and moisture through the front wall panel 20, even if the remaining portions of the first and second apertures 70, 71 are covered by the second flap 16 when the flaps 12, 16 are in the closed position. Additionally, as shown in FIG. 5, when the first flap 12 is in the open position, the arcuate edges 121 of the first and second apertures 70, 71 can flex inward toward the apertures 70, 71 to provide additional support for the receptacle 44.

The first body portion 10 can further include a first flap base 102 proximate the first flap 12, and the second body portion 14 can include a second flap base 104 proximate the second flap 16. For example and with reference to the blank 200 of FIG. 11, angled or arcuate first body flap base score lines 106 can define outer portions of the first body flap base 102, and angled or arcuate second body flap base score lines 108 can define outer portions of the second body flap base 104. The first body flap base score lines 106 are each cut from an end of the first wall flap fold lines 27 to proximate the rim 52 and the first flap fold lines 68, and the second body flap base score lines 108 are each cut from an end of the second wall flap fold lines 29 to proximate the second flap fold line 74. In the closed position, the body flap base score lines 106, 108 allow the flap bases 102, 104 to selectively flex inward toward each other and thus increase the amount of overlap between the flaps 12, 16. In this manner, at least partially due to the length of the tab score lines 78, 80, the tab 72 can selectively cover a greater portion of apertures 70, 71 in the lid 90 to adjust the amount of venting from the apertures 70, 71. Additionally, the added flexibility of the flap bases 102, 104 can allow for flexible expansion of the container 100 to accommodate contents of a greater size or irregular shape.

As embodied herein, the first body flap base score lines 106 and the second body flap base score lines 108, each being arcuate in shape, define a varied width across the first flap base 102 and the second flap base 104, respectively. In the closed position of FIGS. 6-10, the varied width of the first flap base 102 and the second flap base 104 define side venting apertures 112 to allow for additional circulation of air and venting of excess heat and moisture in the container 100 from the side walls 30.

The first flap base 102 is also partially defined by first flap base fold lines 110, each formed from an end of the first wall flap fold lines 27 to the first aperture 70 and the second aperture 71, respectively. The first flap base fold lines 110 can provide additional flexibility for the foldable support 42 in the open position. Further, an angle of the first flap base fold lines 110 relative to the first flap fold lines 68 can provide a transitional plane from the side walls 30 to the foldable support 42 in the open position to release stress in the first body portion 10 due to folding back the first flap 12 from the rounded edges of the front wall panel 20.

As shown in the blank 200 of FIG. 11, a notch 114 can be provided in the rim 52 of the first flap 12. The notch 114 can be sized to accommodate a portion of the tab 72 near the arcuate tab edge 76 of the second flap 16 of an adjacent blank on a sheet of blank material. This allows the blanks 200 to be closely spaced on a sheet of blank material to minimize waste. The notch 114 can be omitted in a case where a notch-less rim 52 for the container is desired.

FIGS. 12-16 show alternative embodiments for a blank for forming a food container having alternative features according to the disclosed subject matter. In the alternative embodiment of FIG. 12, a blank 300 for forming a food container having first and second body portions 305, 310 with an alternative configuration is shown. In the alternative embodiment of FIG. 13, a blank 400 for forming a food container having a first foldable support 405 and a second foldable support 410 is shown. In the alternative embodiment of FIG. 14, a blank 500 for forming a food container having a tab 505 with an alternative configuration is shown. In the alternative embodiment of FIG. 15, a blank 600 for forming a food container having a foldable support 605 with an alternative configuration and a tab 610 with an alternative configuration is shown. In the alternative embodiment of FIG. 16, a blank 700 for forming a food container having a first foldable support 705 and a second foldable support 710, the first foldable support 705 and the second foldable support 710 each having the alternative configuration shown in the embodiment of FIG. 14.

The containers disclosed herein are preferably disposable, but it is contemplated that they may be reused at a future time. Also, the containers can be constructed from materials suitable to be placed in a heating apparatus, such as a microwave, to heat the food and/or used for storage in the refrigerator or freezer. Additionally, the materials from which the food container 100 is made need not be the same throughout. The containers and blanks described herein can be manufactured from any suitable material, including but not limited to paperboard.

It is to be recognized that the dimensions and relative proportions of the first body portion 10, second body portion 14, flaps 12, 16, etc. of the food container 100 or blank 200 will vary according to the exact size and intended use of the food container 100 or blank 200. While an essentially rectangular food container 100 formed by blank 200 is illustrated in FIGS. 1-11, one of ordinary skill will recognize that any suitable shape and depth of food container 100 and corresponding blank 200 can be employed and the disclosed subject matter is not so limited. Other suitable shapes include triangles, cylinders, ovals, various polygons, etc, having any suitable dimensions.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A food container comprising:

a first body portion and a second body portion joined together to define an interior of the container and a mouth to the interior;

the first body portion having a first flap moveable between an open position and a closed position, the first flap including a foldable support formed therein to hold a receptacle when in the open position, a first flap fold line to fold the first flap to the closed position, the closed position substantially perpendicular to the first body portion, and at least one aperture at least partially defined by a boundary portion extending below the first flap fold line;

the second body portion having a second flap moveable between an open position and a closed position, the second flap including a tab to engage the first flap in the closed position to form a lid across the mouth of the interior;

wherein the at least one aperture is further defined in the lid, the second flap configured to flexibly cover a selectable portion of the at least one aperture in the lid to adjust an amount of venting from the lid.

2. The food container of claim 1, wherein the second flap engages the at least one aperture in the closed position, the at least one aperture permitting venting below the first flap fold line in the closed position.

3. The food container of claim 1, wherein the first flap further comprises a rim surrounding at least a portion of the foldable support in the open position.

4. The food container of claim 1, the foldable support comprising a first support portion and a second support portion, the first support portion being substantially perpendicular to the second support portion in the open position.

5. The food container of claim 4, wherein one of the first support portion or the second support portion is substantially trapezoidal and the other support portion is substantially rectangular.

6. The food container of claim 1, the first body portion and the second body portion each having at least one side flap, the first body portion and the second body portion being joined together along at least a portion of each side flap to define opposing side walls of the container.

7. The food container of claim 6, wherein the first flap and the second flap each engage at least one of the opposing side walls in the closed position.

8. The food container of claim 6, further comprising a base portion, the base portion having at least one base flap extending between the first body portion and the second body portion.

9. The food container of claim 1, wherein at least one of the first body portion or the second body portion further includes a flap base proximate the corresponding first flap or second flap, the flap base having a varied width to define a venting aperture when the corresponding first flap or second flap is in the closed position.

10. A food container comprising:

a first body portion and a second body portion joined together to define an interior of the container and a mouth to the interior;

the first body portion having a first flap moveable between an open position and a closed position, the first flap including a foldable support formed therein to hold a receptacle when in the open position, the foldable support including a first support portion and a second support portion, the first support portion being substantially perpendicular to the second support portion in the open position;

the second body portion having a second flap moveable between an open position and a closed position, the second flap including a tab to engage the first flap in the closed position to form a lid across the mouth of the interior, wherein one of the first support portion or the second support portion is substantially trapezoidal and the other support portion is substantially rectangular.

11. The food container of claim 10, wherein the first flap further comprises a first flap fold line to fold the first flap to the closed position, the closed position substantially perpendicular to the first body portion.

12. The food container of claim 11, wherein the first flap further comprises at least one aperture at least partially defined by a boundary portion extending below the first flap fold line.

13. The food container of claim 12, wherein the at least one aperture is further defined in the lid, the second flap configured to flexibly cover a selectable portion of the at least one aperture in the lid to adjust an amount of venting from the lid.

14. The food container of claim 10, the foldable support further comprising a third support portion disposed between the first support portion and the second support portion.

15. The food container of claim 14, wherein the third support portion is substantially parallel to one of the first support portion or the second support portion in the open position and is substantially parallel to the other support portion in the closed position.

16. The food container of claim 14, the third support portion comprising a hinge.

17. The food container of claim 10, wherein the first flap further comprises a first aperture and a second aperture, the foldable support being disposed between the first aperture and the second aperture.

18. The food container of claim 17, wherein the tab further comprises a first tab lock flap and a second tab lock flap, the first tab lock flap and the second tab lock flap each engaging a portion of a corresponding one of the first aperture and the second aperture in the closed position to secure the lid.

19. A food container comprising:

a first body portion and a second body portion joined together to define an interior of the container and a mouth to the interior;

the first body portion having a first flap moveable between an open position and a closed position, the first flap including a foldable support formed therein to hold a receptacle when in the open position;

the second body portion having a second flap moveable between an open position and a closed position, the second flap including a tab to engage the first flap in the closed position to form a lid across the mouth of the interior;

wherein the first flap further comprises a first aperture and a second aperture, the foldable support being disposed between the first aperture and the second aperture.

20. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap including a support flap edge and having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap;

wherein at least one of the tab flap edge and the support flap edge are substantially arcuate.

21. The blank of claim 20, wherein the support flap edge at least partially defines a rim surrounding at least a portion of the foldable support.

22. The blank of claim 20, the foldable support comprising a first support portion and a second support portion, the first support portion and the second support portion joined at a support portion fold line.

23. The blank of claim 22, wherein one of the first support portion or the second support portion is substantially trapezoidal and the other support portion is substantially rectangular.

24. The blank of claim 22, the foldable support further comprising a third support portion disposed between the first support portion and the second support portion, the third support portion joined to the first support portion at a third support portion first fold line and the third support portion joined to the second support portion at a third support portion second fold line.

25. The blank of claim 22, the second support portion at least partially defined by substantially parallel second support portion score lines, the second support portion score lines founed in the first body portion perpendicular to the foldable support body fold line.

26. The blank of claim 20, the first body portion and the second body portion each having at least one side flap defined by at least one side flap fold line.

27. The blank of claim 20, the base portion having at least one base flap defined by at least one base flap fold line.

28. The blank of claim 20, wherein at least one of the first body portion or the second body portion further includes a flap base proximate the corresponding first flap or second flap, at least one arcuate body flap base score line defining at least a portion of the flap base.

29. The blank of claim 28, wherein the at least one arcuate body flap base score line extends substantially outward from a side of the at least one body portion including the flap base to proximate the corresponding one of the first flap fold line or the second flap fold line.

30. The blank of claim 28, wherein the flap base has a varied width, the varied width at least partially defined by the at least one arcuate body flap base score line.

31. The blank of claim 28, wherein the first body portion includes the flap base, the first flap further comprising at least one body flap base fold line extending from an end of the at least one body flap base score line to a corresponding one of the first aperture or the second aperture.

32. The blank of claim 28, wherein the at least one arcuate body flap base score line is on the first body portion, the first body portion being free of a fold line extending between the at least one arcuate body flap base score line and the foldable support body fold line.

33. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap;

the foldable support including a first support portion and a second support portion, the first support portion and the second support portion joined at a support portion fold line;

wherein one of the first support portion or the second support portion is substantially trapezoidal and the other support portion is substantially rectangular.

34. The blank of claim 33, the first flap further comprising a first aperture and a second aperture, the foldable support being disposed between the first aperture and the second aperture.

35. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap;

the foldable support including a first support portion and a second support portion, the first support portion and the second support portion joined at a support portion fold line, the second support portion at least partially defined by substantially parallel second support portion score lines, the second support portion score lines formed in the first body portion perpendicular to the foldable support body fold line.

36. The blank of claim 35, the first tab score line and the second tab score line each having a first score portion and a first bend, the tab comprising a first fold line defining a first tab lock flap and a second fold line defining a second tab lock flap, the first fold line extending from the first tab score line first bend in the direction of the first tab score line first score portion and the second fold line extending from the second tab score line first bend in the direction of the second tab score line first score portion.

37. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap;

the first flap further comprising a first aperture and a second aperture, the foldable support being disposed between the first aperture and the second aperture.

38. The blank of claim 37, the first flap further comprising a support flap edge.

39. The blank of claim 38, wherein at least one of the tab flap edge and the support flap edge are substantially arcuate.

40. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap, the first tab score line and the second tab score line each having a first score portion and a first bend, the tab comprising a first fold line defining a first tab lock flap and a second fold line defining a second tab lock flap, the first fold line extending from the first tab score line first bend in the direction of the first tab score line first score portion and the second fold line extending from the second tab score line first bend in the direction of the second tab score line first score portion.

41. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap;

wherein at least one of the first body portion or the second body portion further includes a flap base proximate the corresponding first flap or second flap, at least one arcuate body flap base score line defining at least a portion of the flap base, and wherein the at least one arcuate body flap base score line extends substantially outward from a side of the at least one body portion including the flap base to proximate the corresponding one of the first flap fold line or the second flap fold line.

42. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap;

wherein at least one of the first body portion or the second body portion further includes a flap base proximate the corresponding first flap or second flap, at least one arcuate body flap base score line defining at least a portion of the flap base, and wherein the first body portion includes the flap base, the first flap further comprising at least one body flap base fold line extending from an end of the at least one body flap base score line to a corresponding one of the first aperture or the second aperture.

43. The blank of claim 42, at least one of the first flap or the second flap including a notch, the notch being configured to accommodate at least a portion of the other flap of an adjacent similarly configured blank on a sheet of blank material.

44. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap, at least one of the first flap or the second flap including a notch, the notch being configured to accommodate at least a portion of the other flap of an adjacent similarly configured blank on a sheet of blank material.

45. A unitary blank for forming a food container comprising:

a first body portion and a second body portion aligned along a longitudinal axis, the first body portion and the second body portion each having a base edge, a base portion extending between the first body portion base edge and the second body portion base edge, the first body portion base edge at least partially defined by a first body portion base fold line and the second body portion base edge at least partially defined by a second body portion base fold line;

the first body portion including a first flap longitudinally opposite the first body portion base edge, the first flap defined by at least one first flap fold line, the second body portion including a second flap longitudinally opposite the second body portion base edge, the second flap defined by at least one second flap fold line;

the first flap having a foldable support formed therein, the foldable support joined to the first flap by a foldable support flap fold line, the foldable support joined to the first body portion at a foldable support body fold line; and the second flap including a tab, the tab defined by a first tab score line and a second tab score line, the first tab score line and the second tab score line extending from a tab flap edge to an inner portion of the second flap;

wherein at least one of the first body portion or the second body portion further includes a flap base proximate the corresponding first flap or second flap, at least one arcuate body flap base score line defining at least a portion of the flap base, and wherein the at least one arcuate body flap base score line is on the first body portion, the first body portion being free of a fold line extending between the at least one arcuate body flap base score line and the foldable support body fold line.

* * * * *